US009839832B2

(12) United States Patent
Aoki

(10) Patent No.: US 9,839,832 B2
(45) Date of Patent: Dec. 12, 2017

(54) BALL GLOVE

(71) Applicant: Trion Corporation, Osaka (JP)

(72) Inventor: Kan Aoki, Osaka (JP)

(73) Assignee: TRION CORPORATION, Osaka (JP)

( * ) Notice: Subject to any disclaimer, the term of this patent is extended or adjusted under 35 U.S.C. 154(b) by 178 days.

(21) Appl. No.: 14/808,577

(22) Filed: Jul. 24, 2015

(65) Prior Publication Data

US 2017/0021265 A1 Jan. 26, 2017

(51) Int. Cl.
*A41D 13/08* (2006.01)
*A63B 71/14* (2006.01)

(52) U.S. Cl.
CPC ..... *A63B 71/143* (2013.01); *A41D 13/08* (2013.01); *A63B 2243/0004* (2013.01)

(58) Field of Classification Search
CPC ..... A63B 71/143; A63B 2069/0011; A63B 69/00; A63B 71/14; A41D 13/08; A41D 19/00
USPC ..... 2/19, 455–456, 20, 161.1, 164; 473/458
See application file for complete search history.

(56) References Cited

U.S. PATENT DOCUMENTS 2,736,028 A * 2/1956 Sternlicht ..... A63B 71/143 2/19
4,192,018 A * 3/1980 Latina ..... A63B 71/143 2/19
4,346,481 A * 8/1982 Latina ..... A63B 71/143 2/19
5,180,165 A * 1/1993 Frost ..... A63B 60/10 2/20
5,379,460 A * 1/1995 Aoki ..... A63B 71/143 2/161.1
5,561,856 A * 10/1996 Pesco ..... A41D 19/01588 2/16
5,815,838 A * 10/1998 Lord ..... A41D 19/01547 2/161.1
6,219,844 B1 * 4/2001 Yamada ..... A63B 71/143 2/19
6,292,946 B1 * 9/2001 Angione ..... A63B 71/141 2/19
6,427,246 B1 * 8/2002 Doi ..... A41D 19/01588 2/159
8,656,513 B2 * 2/2014 Plocher ..... A41D 19/01523 2/16
2001/0025382 A1 * 10/2001 Murai ..... A63B 71/143 2/19
2005/0120453 A1 * 6/2005 Wu ..... A63B 71/143 2/19
2006/0137067 A1 * 6/2006 Wu ..... A41D 19/015 2/19
2008/0060105 A1 * 3/2008 Lin ..... A63B 71/143 2/19

(Continued)

*Primary Examiner* — Sally Haden
*Assistant Examiner* — Jillian K Pierorazio
(74) *Attorney, Agent, or Firm* — Knobbe Martens Olson & Bear LLP

(57) ABSTRACT

A ball glove has a hollow zone at a ball impact zone. The hollow zone accommodates a drop-in assembly to provide adequate protection to the wearer of the ball glove without imparting stiffness to the crotch area or the ball impact zone of the ball glove. The ball glove opens/closes easily so as to provide control which players are seeking and creates a game-day-ready pocket based on the individual player's ball catching habits in a short period of time.

14 Claims, 14 Drawing Sheets

(56) References Cited

U.S. PATENT DOCUMENTS

| | | | | |
|---|---|---|---|---|
| 2008/0250540 | A1* | 10/2008 | Aoki | A63B 71/143 2/19 |
| 2009/0000004 | A1* | 1/2009 | Rumer | A63B 71/143 2/19 |
| 2011/0016596 | A1* | 1/2011 | Rhoades | A63B 71/143 2/19 |
| 2014/0259257 | A1 | 9/2014 | Hewitt et al. | |

* cited by examiner

BALL GLOVE

TECHNICAL FIELD

The present invention relates generally to a ball glove for baseball, softball and other sports. In particular, the present invention relates to a ball glove having a hollow zone at a ball impact zone, which allows the ball glove to open/close and break-in easily and creates a game-day ready pocket in a short time of period.

BACKGROUND

In sports such as baseball and softball, players wear a ball glove on the non-throwing hand for catching the ball. The ball glove is designed to be worn by placing fingers in a finger region of a hand cavity formed by a shell back comprising a back side skin and a shell palm comprising a palm side skin of the ball glove. The shell back and the shell palm of the ball glove are joined at the periphery, except at a hand insertion opening, by lacing, sewing or welting.

One of important function of the ball glove is to provide a wearer protection from an impact of a ball being caught in the ball glove and the ball glove is typically made of material such as leather with layers of padding to dissipate the force exerted on the hand by a caught ball. As indicated in FIG. 2*a*, a ball impact zone X of the ball glove is located at the base of the index finger section. Accordingly, in conventional ball gloves, the layers of padding are fixedly attached by a glue and sewing to a palm lining to cover the ball impact zone without any open room in between, as illustrated in FIG. 3. The ball's impact begins the molding and stretching process of the leather so that a pocket is formed in the impact zone. The pocket of the ball glove is where the wearer can catch the ball tightly.

FIG. 4 illustrates a typical position of the layers of padding in conventional ball glove. It is necessary to provide layers of padding in the ball impact zone for an adequate protection from the impact of the ball being caught. However, the layers of padding fixedly attached to the palm lining increase stiffness of the palm side skin of the ball glove, on which the palm lining is secured and the ball is contacted. The stiffness of the palm side skin of the ball glove not only increases response time to close and open the ball glove but also causes a difficulty to form the pocket in the ball impact zone of the ball glove.

A crotch area is another stiff area in the ball impact zone. The crotch area is the area of a palm shell that separates the index finger section and the thumb section of the ball glove. In the conventional ball glove, a webbing is provided between the thumb section and the index finger section of the ball glove and is coupled to the crotch area to assist a stable and sturdy ball catching. As the webbing, the shell palm, and the back shell are congregated at the crotch area, the crotch area of the conventional ball glove also exhibits stiffness. The stiffness in the crotch area also has a negative impact on the pocket forming process as the ball impact zone includes the crotch area and on the maneuverability of the ball glove to open and close.

Accordingly, a break-in process is required to improve the maneuverability of the ball glove and to form the pocket in a desired spot. In the break-in process, stiff areas in the ball glove are softened by rubbing oils prior to forming the pocket. Ball glove manufacturers make a variety of oils to soften the leather. Shaving cream with lanolin, mink oil, saddle soap, etc. are also used. Wooden mallets or rubber mallets specifically made to pound the pocket are often used to form the pocket. Another practice for forming the pocket of the ball glove is to place a ball in the pocket and tie the glove shut with shoelaces or string for a day or two in an area where the temperature is not extreme.

However these approaches do not create the pocket based on the individual player's ball catching habits. Playing catch with someone would be the best way to break-in as the ball's impact initiates the molding and stretching process of the palm side skin of the ball glove so it will conform to the wearer's hand and catching style. However, breaking-in the ball glove to form the pocket in this way with conventional ball gloves is lengthy and regular work out is needed every day for at least two weeks.

BRIEF SUMMARY OF THE INVENTION

In view of the above mentioned situation, various embodiments of the present invention are directed to a ball glove that can open/close easily so as to provide control which players are seeking and that create a game-day ready pocket based on the individual player's ball catching habits in a short period of time.

According to the present invention, the glove comprises a shell palm comprising a palm side skin and a shell back comprising a back side skin. The palm side skin forms a front wall of the glove while the back side skin forms a back wall of the glove. The palm side skin comprises a crotch flap at the crotch area. In this description, the crotch area is referred to as an area of the palm shell that separates the index finger section and the thumb section of the ball glove. The crotch flap is a part of the palm side skin extending from the crotch area. The crotch flap may be formed into a tubular member.

The shell back is coupled to the shell palm at the periphery, except at the crotch area and at a hand insertion opening, such that a drop-in cavity and a hand cavity are defined and a finger region comprising a plurality of finger sections including an index finger section and a thumb section configured to align with an index finger and a thumb, respectively, of wearer of the glove, is formed. The ball glove has distal and proximal ends. The hand cavity has an opening to insert wearer's hand in the proximal end of the ball glove, while the finger region is located on distal end of the ball glove. The drop-in cavity is a space extending from the crotch area toward the proximal end of the ball glove to accommodate a drop-in assembly, the detail of which is described below, and has an opening at the crotch area.

The ball glove further comprises the drop-in assembly and a webbing coupled to the index finger section, the thumb section and the crotch flap. The drop-in assembly is disposed in the drop-in cavity defined between the shell palm and the shell back such that that a first hollow zone is formed between the shell back and the drop-in crotch and a second hollow zone is formed between the shell palm and the drop-in crotch, and is coupled to the crotch flap. Thus, the drop-in crotch assembly is suspended between the shell palm and the shell back and is not coupled to the shell back.

The drop-in assembly comprises a pad cover layer having a shock absorb pad area surrounded by a pocket stabilizer area and a drop-in crotch to which the crotch flap is coupled and may further comprise a first shock absorb layer and a second shock absorb layer in the shock absorb pad area. The pad cover layer may further comprise a slit aperture in the pocket stabilizer area along a contour of the shock absorb pad area. The pocket stabilizer area of the drop-in assembly may be attached to the shell palm.

The shock absorb pad area may further comprise a plurality of slits to impart flexibility and air permeability to the shock absorb pad area. An area of the shell back corresponding to the crotch area of the shell palm may be shifted toward a proximal end of the grove so that a part of the drop-in crotch is exposed from the shell back.

In one embodiment, the ball glove may further comprise a palm lining and a back lining secured to the shell back on a side opposite to the back wall of the glove. The palm lining is coupled to the back lining to define the hand cavity and to form the finger region, and the shell back is coupled to the shell palm except at the crotch area to define the drop-in cavity. The drop-in assembly is disposed in the drop-in cavity defined between the shell palm and the palm lining such that the first hollow zone is formed between the drop-in assembly and the palm lining and the second hollow zone is formed between the drop-in assembly and the shell palm.

The pocket stabilizer area of the drop-in crotch may be attached to the shell palm. The shock absorb pad area may further comprise a plurality of slits to impart flexibility and permeability to the shock absorb pad area and an area of the shell back corresponding to the crotch area of the shell palm may be shifted toward a proximal end of the grove so that a part of the drop-in crotch is exposed from the shell back.

The foregoing and other objectives and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiment may be utilized and the structural changes may be made without departing from the scope of the invention. The accompanying drawing, therefore, is submitted merely as showing the preferred exemplification of the invention. Accordingly, the following detail description is not to be taken in a limiting sense, and the scope of the present invention is best defined by the appended claims.

BRIEF DESCRIPTION OF THE DRAWINGS

Reference will now be made to the accompanying drawing, showing by way of illustration a particular embodiment of the present invention. The illustrated embodiment is merely examples of the present invention and do not limit the scope of the invention.

DETAILED DESCRIPTION OF THE INVENTION

Hereafter, the ball glove of the present invention will be described in detail by way of preferable embodiment shown in the attached drawings. Unless defined otherwise, all technical and scientific terms used herein have the same meaning as is commonly understood by one skill in the art. In the following detailed description of the present invention, numerous specific details are set forth in order to provide a through understanding of the present invention. However, it will be obvious to one with ordinary skill in the art that the present invention may be practiced without these specific details. In other instances, well known methods, procedures, components, and mechanism have not been described in detail as not to unnecessarily obscure aspects of the present invention.

Figure 1A:
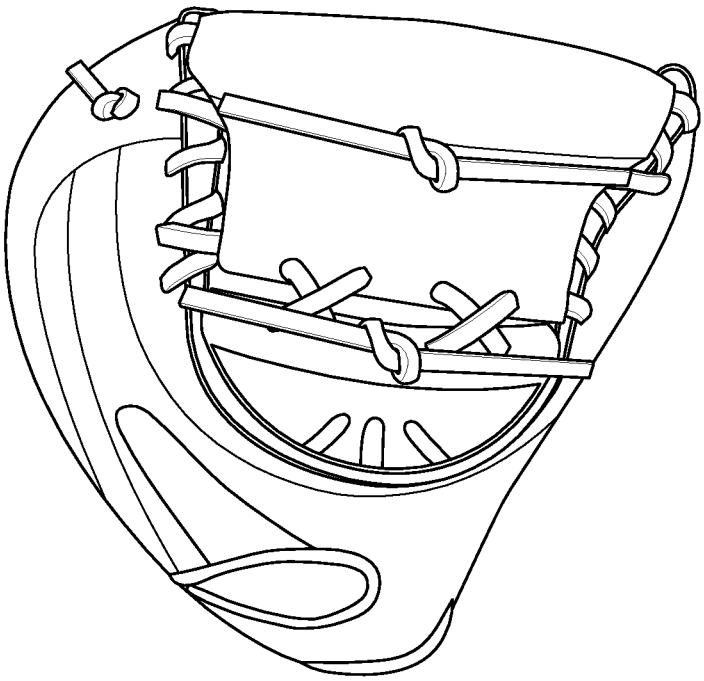
FIG. 1*a* is a back perspective view of the ball glove in accordance with some of embodiments of the present invention.
Figure 1B:
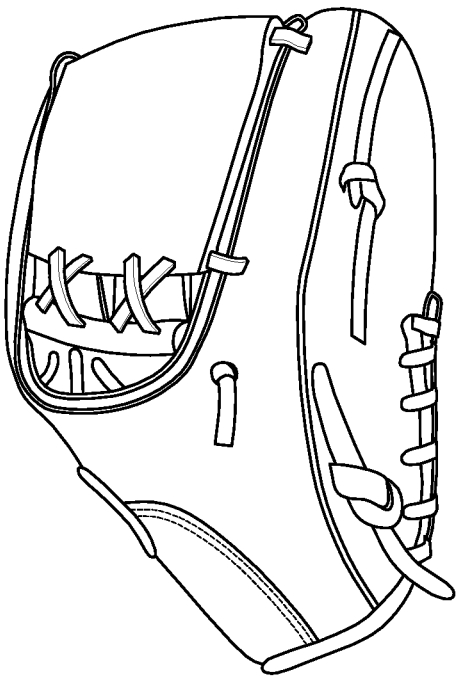
FIG. 1*b* is a back perspective view of the ball glove in accordance with some of embodiments of the present invention.
Figure 1C:
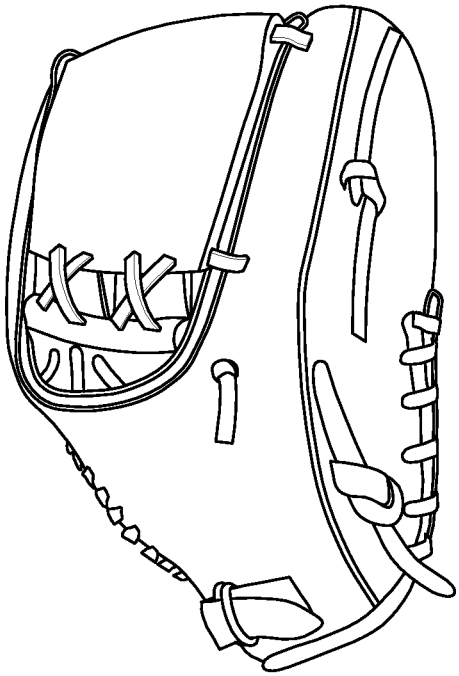
FIG. 1*c* is a back perspective view of the ball glove in accordance with some of embodiments of the present invention.

FIG. 1*a*, FIG. 1*b*, and FIG. 1*c* illustrate a ball glove 1 in accordance with some of embodiments of the present invention. FIG. 1*a* illustrates a mitt style, FIG. 1*b* illustrates regular style, and FIG. 1*c* illustrates a fast back style. The figures are shown in a left-handed glove. However, the present invention is not limited to the left-handed glove. A right-handed glove would be substantially identical to the left-handed glove. The ball glove 1 has distal and proximal ends. The hand cavity define by the shell back 4 and the shell palm 2 has an opening for a hand cavity 31 to insert wearer's hand in the proximal end of the ball glove and the finger region 18 is located on the distal end of the ball glove.

Figure 2A:
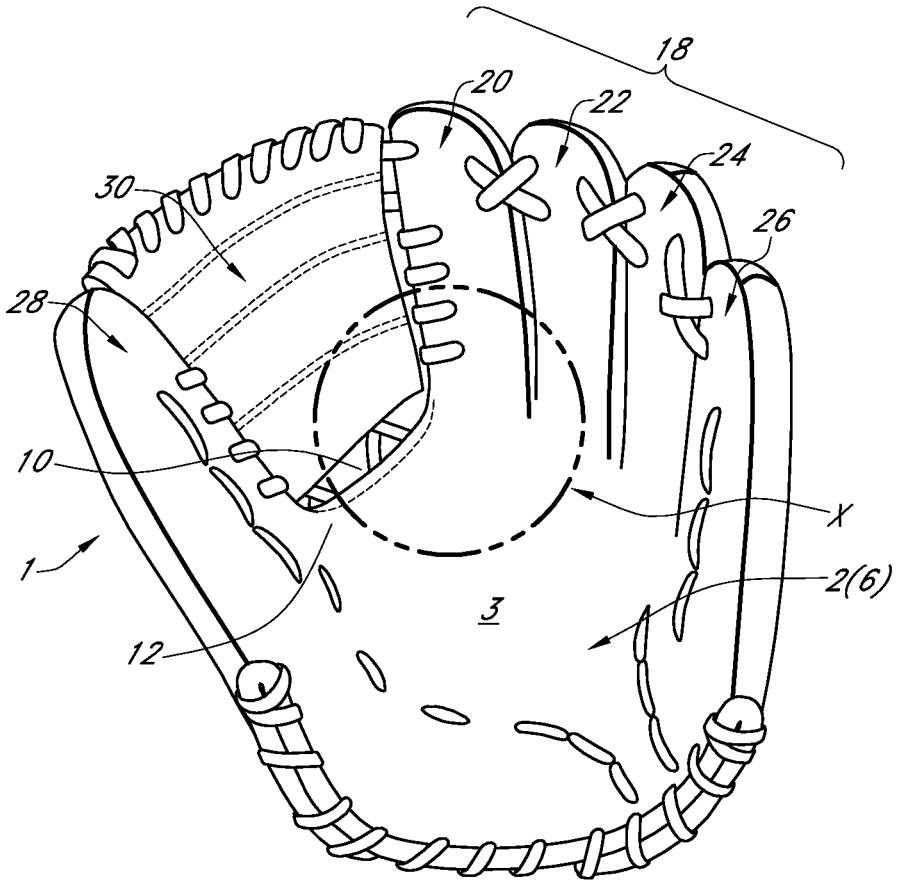
FIG. 2*a* is a front perspective view of the ball glove in an open position indicating a ball impact zone X in accordance with some of embodiments of the present invention.
Figure 2B:
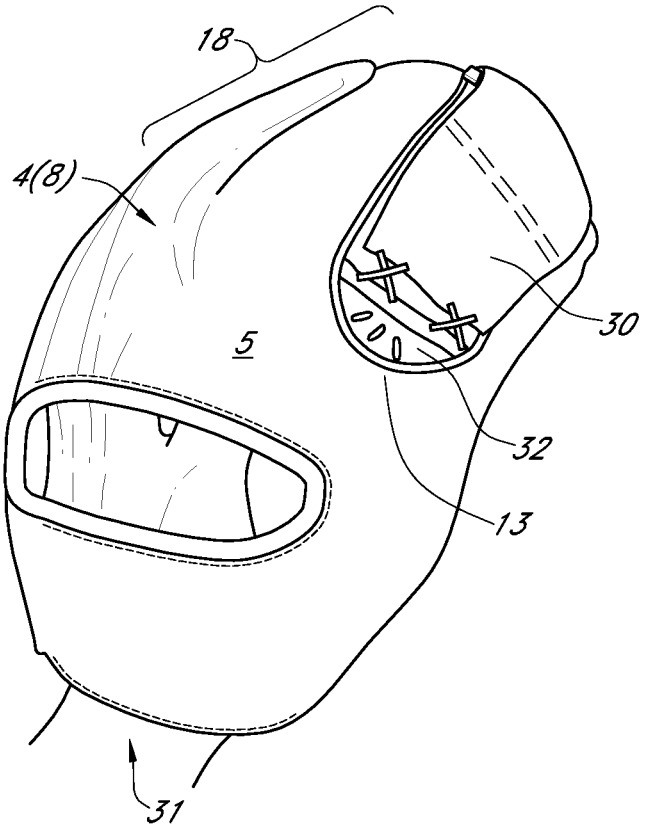
FIG. 2*b* is a back perspective view of the ball glove in accordance with some of embodiments of the present invention.
Figure 3:
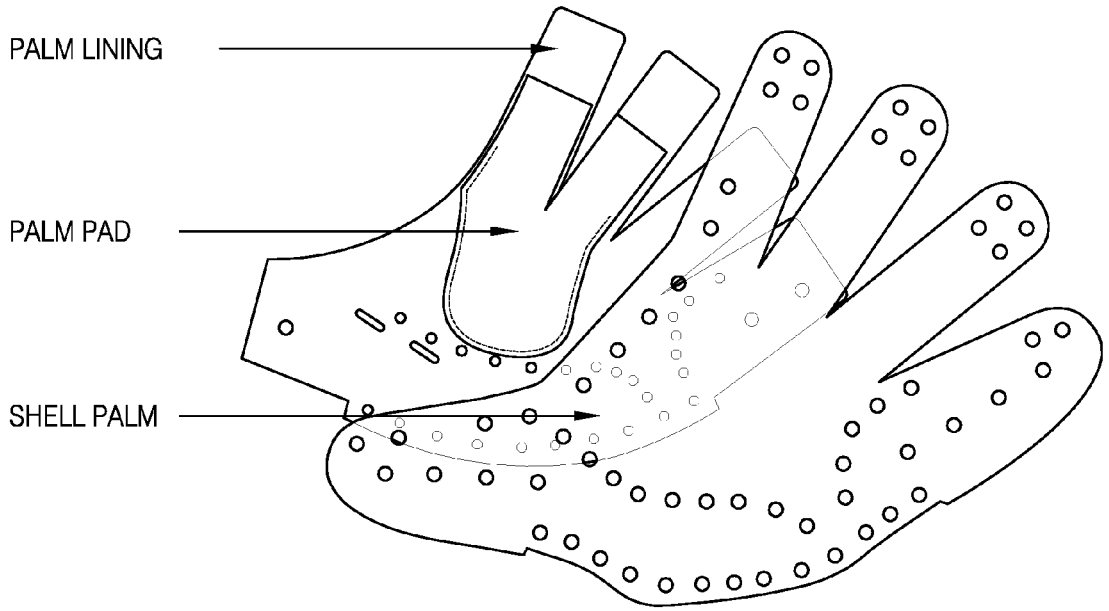
Fig. 3 (PRIOR ART)
FIG. 3 illustrates a palm pad attached to a palm lining of the conventional ball glove.
Figure 4:
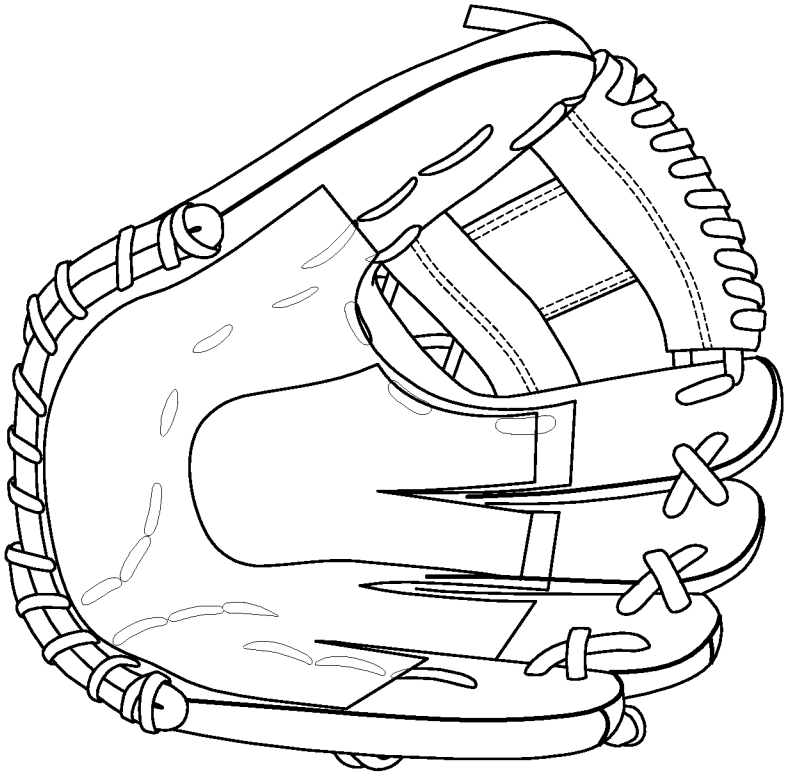
Fig. 4 (PRIOR ART)
FIG. 4 illustrates a specific position of the palm pad of the conventional ball glove.

As illustrated in FIG. 2*a* and FIG. 2*b*, the ball glove 1 comprises a shell palm 2 comprising a palm side skin 6 having a crotch flap 10 at a crotch area 12, which is located between the index finger section 20 and a thumb section 28, and a shell back 4 comprising a back side skin 8. The shell palm 2 and the shell back 4 are coupled at the periphery, except at the crotch area 12 and at a hand insertion opening 31, to define a drop-in cavity 33 and a hand cavity (not shown in the drawings), respectively and to form a finger region 18. The shell palm 2 and the shell back 4 may be coupled by any suitable method such as stitching, gluing, lacing or welting.

Figure 9:
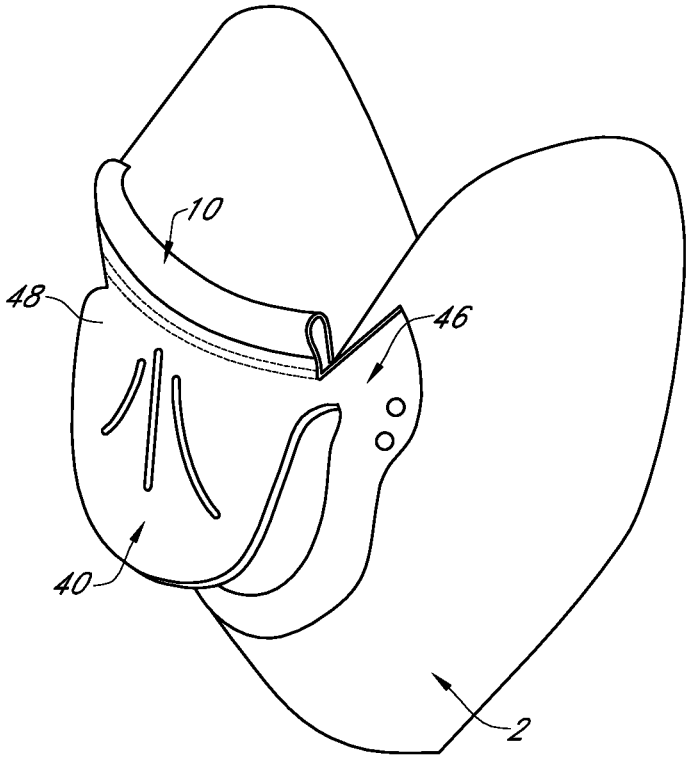
FIG. 9 is a schematic view of the drop-in assembly attached to the shell palm in accordance with some of embodiments of the present invention.
Figure 10:
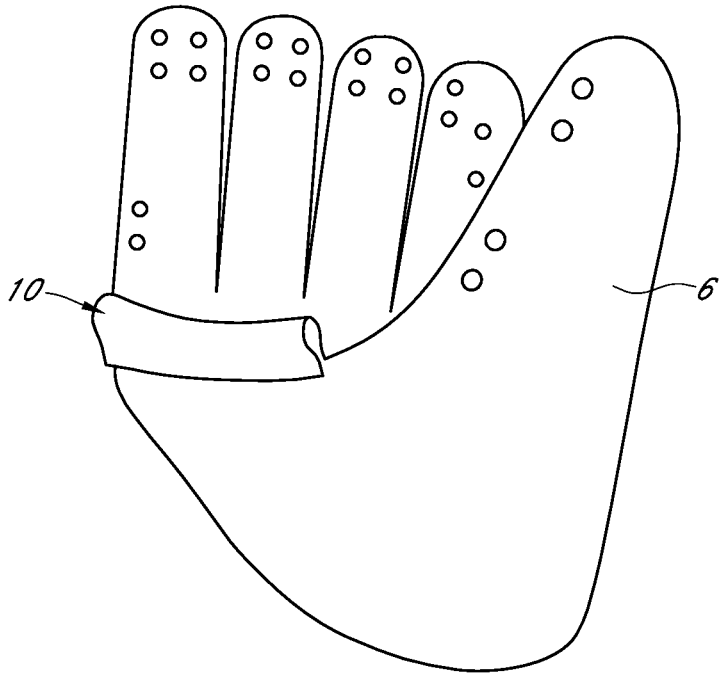
FIG. 10 is a schematic view of the crotch flap formed into a tubular member.

The finger region 18 comprising a plurality of finger sections 20, 22, 24, 26, including an index finger section 20 and a thumb section 28 configured to align with an index finger and a thumb, respectively, of wearer of the glove. The palm side skin 6 forms a front wall 3 of the glove and the back side skin 8 forms a back wall 5 of the glove. The ball glove 1 further comprises a drop-in assembly 32 and a webbing 30 which is coupled to the index finger section 20, the thumb section 28, and the crotch flap 10. As illustrated in FIG. 9, the crotch flap 10 is a part the palm side skin 6, extending from the crotch area 12, toward the distal end of the ball glove 1, and may be formed into a tubular member.

Figure 6:
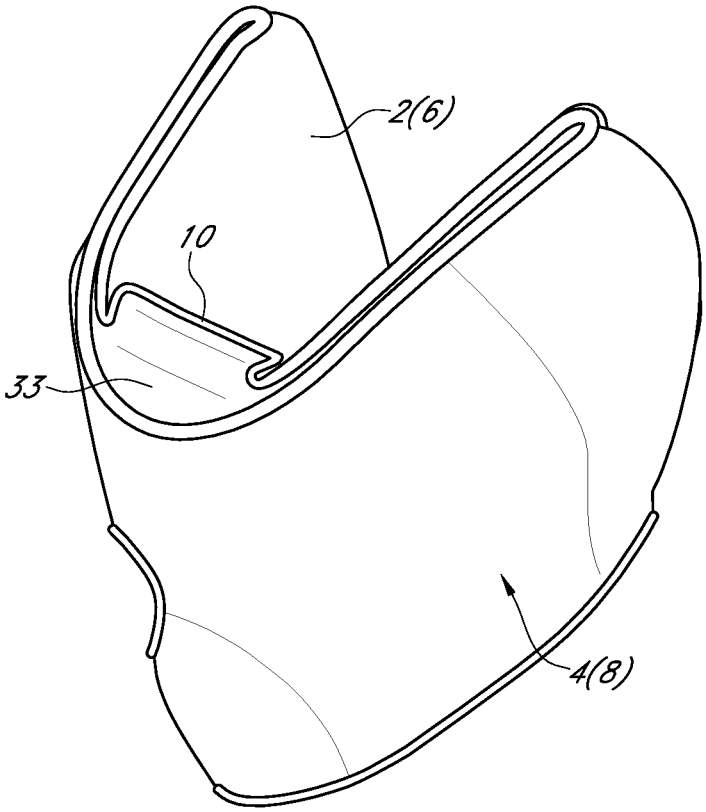
FIG. 6 is a schematic view of the shell palm coupled to the shell back to define the drop-in cavity.
Figure 7:
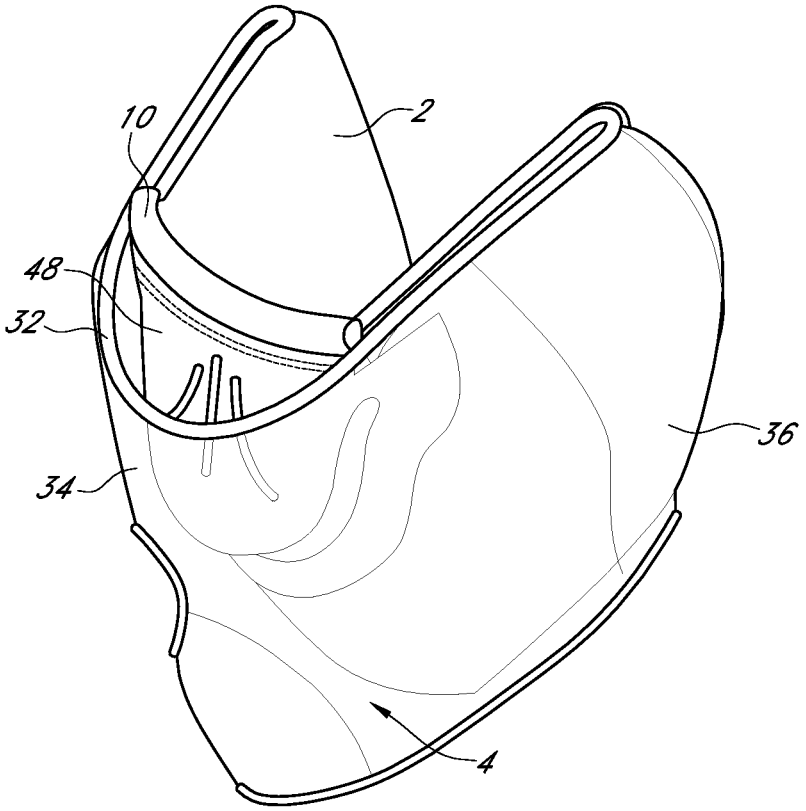
FIG. 7 is a schematic view of the shell palm coupled to the shell back having the drop-in assembly there between in accordance with some of embodiments of the present invention.

As illustrated in FIG. 6 and FIG. 7, the drop-in cavity 33 is a space between the shell palm 2 and the shell back 4, to accommodate the drop-in assembly 32 extending from the crotch area 12 toward the proximal end of the ball glove 1 and has an opening at the crotch area 12. Thus, the shell palm 2 and the shell back 4 are not joined at the crotch area 12, while, in a conventional glove, the shell palm and the shell back are joined at the crotch area either by lacing, sewing or welting. Accordingly, stiffness at the crotch area 12 is significantly reduced compared with the conventional glove.

Figure 5:
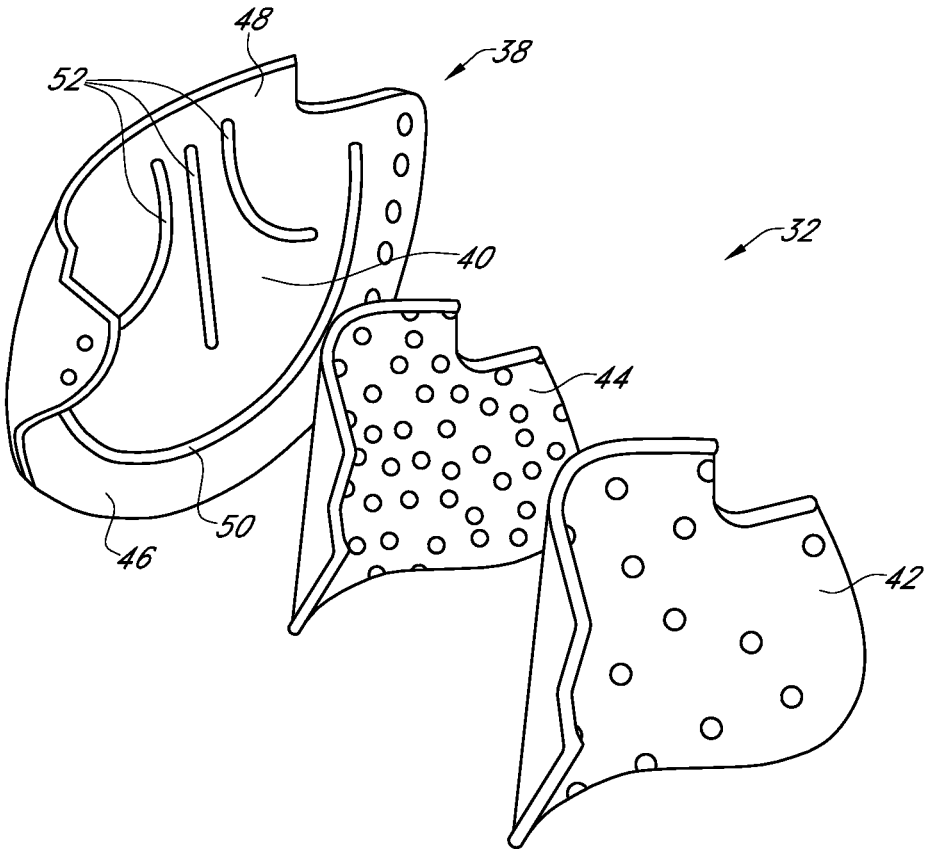
FIG. 5 is an explosion view of a drop-in assembly in accordance with some of embodiments of the present invention.

FIG. 5 illustrates the drop-in assembly 32. The drop-in assembly 32 comprises a pad cover layer 38 having a shock absorb pad area 40 surrounded by a pocket stabilizer area 46 and a drop-in crotch 48 to which the crotch flap 10 is coupled. The drop-in assembly may further comprise a first shock absorb layer 42 and a second shock absorb layer 44 in the shock absorb pad area 40 to provide extra protection to the wearer. The palm side skin 6, the back side skin 8, the webbing 30, and the drop-in assembly 32 can be made of any suitable material or materials known in the art, whether natural or synthetic, which include but are not limited to rubber, leather or synthetic leather, preferably cowhide leather. The first shock absorb layer 42 is preferably made of a dense material to lessen a hand impact and the second shock absorb layer 44 is a shock absorb foam that is soft and flexible, but tough on impact.

Figure 8:
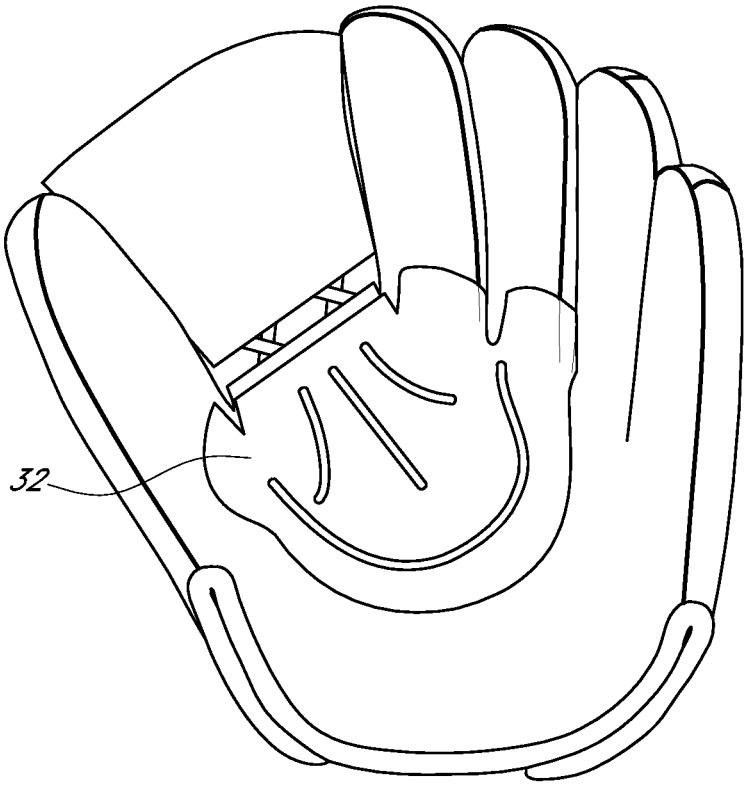
FIG. 8 illustrates a position of the drop-in assembly in accordance with some of embodiments of the present invention.

As illustrated in FIG. 7, the drop-in assembly 32 is disposed in the drop-in cavity 33 defined between the shell palm 2 and the shell back 4 and the drop-in crotch 48 is coupled to the crotch flap 10 such that a first hollow zone 34 is formed between the shell back 4 and the drop-in assembly 32 and a second hollow zone 36 is formed between the shell palm 2 and the drop-in assembly 32. Thus, the drop-in assembly 32 is suspended between the shell palm 2 and the shell back 4 and is not coupled to either the shell back 4 or the shell palm 2. Further as illustrated in FIG. 8, the drop-in cavity 33 is substantially overlapping with the impact zone X. Accordingly, the first hollow zone 34 and the second hollow zone 36 allow the drop-in assembly 32 to move freely in the impact zone X, where it can expand creating the pocket, so that the pocket based on the individual player's ball catching habits can be created. Moreover, the drop-in assembly 32 provides a protection to the wearer without imparting stiffness to the crotch are 12 or the impact zone X in the shell palm 2.

As illustrated in FIG. 5 and FIG. 9, the pad cover layer 38 may further comprises a slit aperture 50 in the pocket stabilizer area 46 along a contour of the shock absorb pad area 40 and the pocket stabilizer area 46 of the drop-in assembly 32 may be attached to the shell palm 2 so as to serve as pocket shape enhancer and help the shock absorb pad area 40 to stay in the impact zone X. The shock absorb pad area 40 may comprise a plurality of slits 52 to impart flexibility and air permeability to the shock absorb pad area 40, to further enhance the break-in process. An area of the shell back corresponding to the crotch area 13 may be shifted toward a proximal side of the grove 1 so that the stiffness at the crotch area 12 is further reduced so that the maneuverability of the ball glove is improved.

Figure 11:
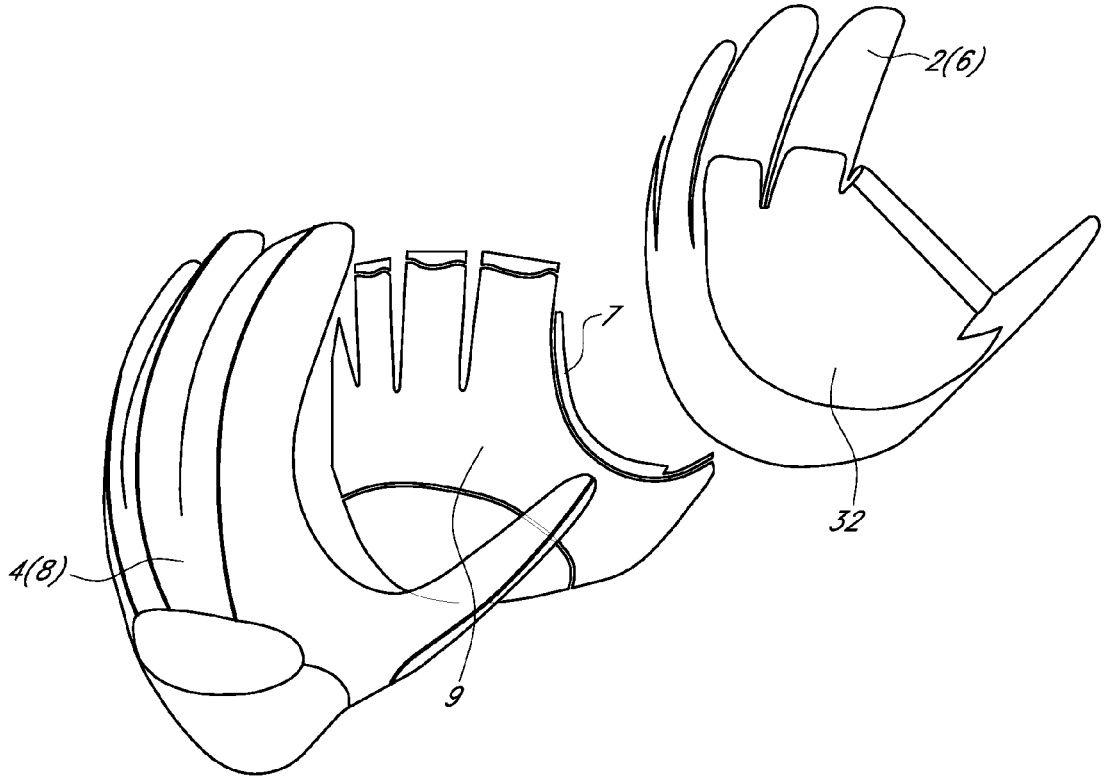
FIG. 11 is a schematic view of one of embodiments of the present invention.

FIG. 11 illustrates one of the embodiments of the present invention. The ball glove 1 may further comprise a palm lining 7 and a back lining 9 which is secured to the shell back 4 on a side opposite to the back wall 5 of the glove 1. The palm lining 7 is coupled to the back lining 9 to define the hand cavity at the periphery, except at the hand insertion opening 31, such that the hand cavity is defined and the finger region 18 is formed, and the shell back 4 is coupled to the shell palm 2, except at the crotch area, such that the drop-in cavity 33 to accommodate the drop-in assembly 32 is defined.

In this embodiment, the drop-in assembly 32 is disposed in the drop-in cavity 33 defined between the shell palm 2 and the palm lining 7 such that the first hollow zone 34 is formed between the drop-in assembly 32 and the palm lining 7 and the second hollow zone 36 is formed between the drop-in assembly 32 and the shell palm 2. Accordingly, addition of the palm lining 7 and the back lining 9 does not impart stiffness to the crotch are 12 or the impact zone X in the shell palm 2, as the palm lining 7 and the back lining 9 are not coupled to either the crotch area 12 or an area corresponding to the impact zone X of the shell palm 2.

The back lining 9 and the palm lining 7 can be made of any suitable material or materials known in the art, whether natural or synthetic, which include but not limited to rubber, leather or synthetic leather, preferably cowhide or pigskin. More preferably, tacky or non-slip material is used for the palm lining 7 to provide traction or grip to the wearer's index finger.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What claimed is:

1. A ball glove comprising:

a shell palm comprising a palm side skin having a crotch flap at a crotch area thereof, the crotch area defined by the separation of an index finger section and a thumb section of the ball glove, a shell back comprising a back side skin coupled to the palm side skin at a periphery, except at the crotch area and at a hand insertion opening, such that a drop-in cavity and a hand cavity are defined and a finger region comprising a plurality of finger sections including the index finger section and the thumb section configured to align with an index finger and a thumb, respectively, of wearer of the glove, is formed, a webbing coupled to the index finger section, the thumb section and the crotch flap, and a drop-in assembly, wherein the drop-in assembly is disposed in the drop-in cavity defined between the shell palm and the shell back and is coupled to the crotch flap such that a first hollow zone is formed between the shell back and the drop-in assembly and a second hollow zone is formed between the shell palm and the drop-in assembly, and the drop-in crotch assembly is suspended between the shell palm and the shell back and is not coupled to the shell back.

2. The ball glove according to claim 1, wherein the drop-in assembly comprises:

a pad cover layer comprising:

a shock absorb pad area, a pocket stabilizer area surrounding the shock absorb pad area, and a drop-in crotch area to which the crotch flap is coupled, and at least one shock absorb layer in the shock absorb pad area.

3. The ball glove according to claim 2, wherein the pad cover layer further comprises a slit aperture in the pocket stabilizer area along a contour of the shock absorb pad area.

4. The ball glove according to claim 3, wherein the pocket stabilizer area of the drop-in assembly is attached to the shell palm.

5. The ball glove according to claim 2, wherein the shock absorb pad area comprises a plurality of slits.

6. The ball glove according to claim 1, wherein a part of the drop-in crotch is exposed from the shell back at an area of the shell back corresponding to the crotch area of the palm side.

7. The ball glove according to claim 1, wherein the crotch flap is formed into a tubular member.

8. The ball glove according to claim 1, further comprising: a palm lining and a back lining secured to the shell back wherein: the palm lining is coupled to the back lining at the periphery, except at the hand insertion opening, such that the hand cavity is defined and the finger region is formed, the shell back is coupled to the shell palm at the periphery, except at the crotch area, such that the drop-in cavity is defined, the drop-in assembly is disposed in the drop-in cavity defined between the shell palm and the palm lining such that the first hollow zone is formed between the drop-in assembly and the palm lining and the second hollow zone is formed between the drop-in assembly and the shell palm.

9. The ball glove according to claim 8, wherein the drop-in assembly comprises:

a pad cover layer comprising:

a shock absorb pad area, a pocket stabilizer area surrounding the shock absorb pad area, and a drop-in crotch area to which the crotch flap is coupled, and at least one shock absorb layer in the shock absorb pad area.

10. The ball glove according to claim 9, wherein the pad cover layer further comprises a slit aperture in the pocket stabilizer area along a contour of the shock absorb pad area.

11. The ball glove according to claim 10, wherein the pocket stabilizer area of the drop-in assembly is attached to the shell palm.

12. The ball glove according to claim 9, wherein the shock absorb pad area comprises a plurality of slits.

13. The ball glove according to claim 8, wherein a part of the drop-in crotch is exposed from the shell back at an area of the shell back corresponding to the crotch area of the palm side.

14. The ball glove according to claim 8, wherein the crotch flap is formed into a tubular member.

* * * * *